United States Patent [19]

Kroon et al.

[11] Patent Number: 4,895,084

[45] Date of Patent: Jan. 23, 1990

[54] STOKER FOR REFUSE INCINERATORS

[75] Inventors: Stanley W. Kroon, Long Island City; Thomas Tsaveras, Elmont, both of N.Y.

[73] Assignee: Morse Boulger, Inc., Long Island, N.Y.

[21] Appl. No.: 134,830

[22] Filed: Dec. 18, 1987

[51] Int. Cl.[4] ..... F23B 1/22

[52] U.S. Cl. ..... 110/255; 110/257; 110/259; 110/281; 110/282

[58] Field of Search ..... 110/224, 227, 228, 235, 110/255, 257, 258, 259, 267, 268, 278, 281, 282, 286, 291

[56] References Cited

U.S. PATENT DOCUMENTS

| | | | |
|---|---|---|---|
| 1,644,953 | 10/1927 | Seyboth | 110/281 |
| 1,913,396 | 6/1933 | Kay | 110/282 |
| 2,250,067 | 7/1941 | Martin | 110/282 |
| 3,413,938 | 12/1968 | Dvirka | 110/281 X |
| 3,537,410 | 11/1970 | Zanff | 110/259 X |
| 3,722,433 | 3/1973 | Kramer | 110/255 X |
| 4,103,627 | 8/1978 | Mainka | 110/281 |
| 4,320,710 | 3/1982 | Steiner et al. | 110/281 |
| 4,471,704 | 9/1984 | John et al. | 110/257 X |
| 4,676,176 | 6/1987 | Bonomelli | 110/281 |

*Primary Examiner*—Henry C. Yuen

*Attorney, Agent, or Firm*—Lalos & Keegan

[57] ABSTRACT

A stoker consisting of a support frame, a stationary assembly of longitudinally spaced sets of grates mounted on the support frame, a first movable assembly of longitudinally spaced sets of grates mounted on the support frame, the first movable assembly having first and second pluralities of grate sets, the first plurality of grate sets being disposed in a first set of alternate spaces between sets of grates of the stationary assembly, the second plurality of grate sets being disposed in successive spaces between sets of grates of the stationary assembly, a second movable assembly of longitudinally spaced sets of grates mounted on the support frame, the sets of grates of the second movable assembly being disposed in a second set of alternate spaces between sets of grates of the stationary assembly, and means for reciprocating the first and second movable assemblies.

24 Claims, 2 Drawing Sheets

STOKER FOR REFUSE INCINERATORS

Figure 1:
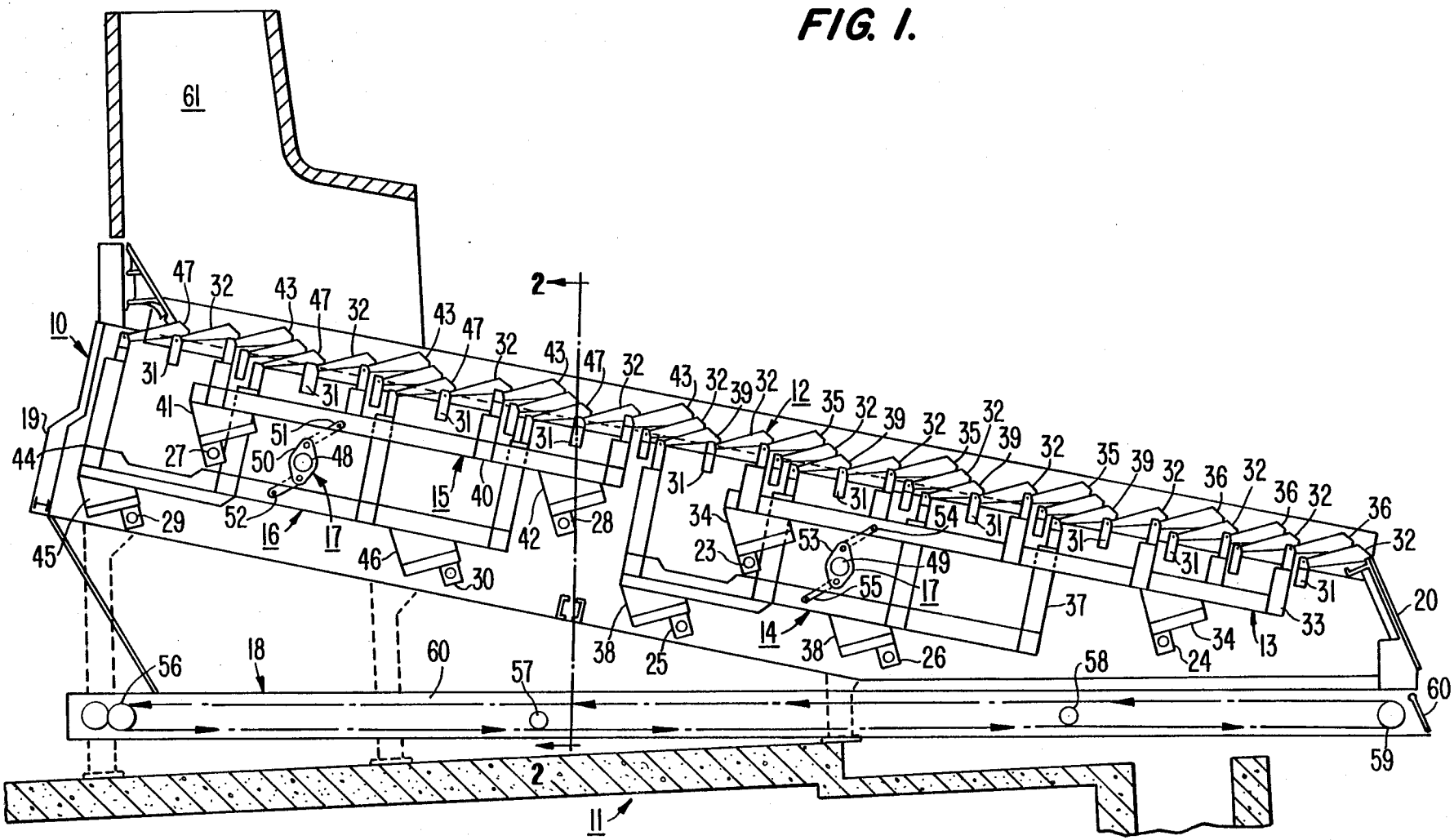

This invention relates to a stoker and more particularly to a reciprocating type of stoker adapted for use in burning refuse. The invention further contemplates a stoker for burning refuse suitable for use in municipal, industrial and commercial incinerators.

In the prior art, there has been developed a reciprocating type of stoker suitable for use in municipal, industrial and commercial incinerators which is operative to tumble refuse deposited thereon to enhance the combustion process as the refuse transits the length of the stoker. Generally, such type of stoker includes a support frame adapted to be installed in an incinerator, a stationary assembly of longitudinally spaced sets of grates mounted on the support frame, a first movable assembly of longitudinally spaced sets of grates mounted on the support frame with the sets of grates thereof disposed in a first set of alternate spaces between sets of grates of the stationary assembly, a second movable assembly of longitudinally spaced sets of grates disposed in a second set of alternate spaces between sets of grates of the stationary assembly, and a drive system for reciprocating the two movable assemblies in opposite directions relative to each other to provide the effect of a series of traveling steps. The stoker includes a feed section disposed at an upper, trailing end thereof on which refuse is deposited, usually through a chute, a combustion section disposed intermediate the end sections thereof in which the principal burning of the refuse occurs, and a burnout section disposed at a lower, leading end of the stoker where incinerated refuse burns out. Such type of reciprocating stoker is illustrated and described in U.S. Pat. No. 3,585,947 which is incorporated herein by reference.

In incinerators in which the type of stoker as described is used, burners are provided in the side walls thereof for igniting the refuse. Combustion of the burning refuse is supported by air supplied above and below the grates of the stoker. Preferably, to obtain optimum combustion, the temperature of the combustion chamber is maintained in the range of 1450° F. and 1650° F. Such range of temperatures is maintained by adjusting the supply of volume of overfire and underfire air. To increase the temperature of the combustion chamber, the supply of underfire air is increased and the supply of overfire air is decreased. Conversely, to lower the temperature of the combustion chamber, the supply of overfire air is increased and the supply of underfire air is decreased.

In operating stokers of the type described, it has been found that the exposure of the grates of the stoker to the high temperature flames in the combustion chamber will result in an accelerated deterioration of the grates, and, correspondingly, in shorter service life. Generally, grates disposed in the feed and combustion sections of a stoker are not unduly subjected to the flames of combustion in that they are sufficiently shielded by the unburnt and partially burnt refuse deposited in such sections. The grates in the burnout section of the stoker, however, have a greater exposure to the flames of combustion in that they are shielded from such flames only by the residue of the burned refuse. Their exposure further is enhanced by the reciprocation of the grates of the movable assemblies which has the effect of disturbing the residue and baring the surfaces of the grates. It thus has been found to be desirable to provide a reciprocating type of stoker of the type described, in which the exposure of all of the grates of the stoker will be shielded from exposure to the flames of combustion during the reciprocation of the movable grates thereof, and particularly the grates in the burnout section of the stoker.

Accordingly, it is the principal object of the present invention to provide an improved stoker.

Another object of the present invention is to provide an improved reciprocating type of stoker suitable for burning refuse.

A further object of the present invention is to provide an improved stoker for burning refuse suitable for use in municipal, industrial and commercial applications.

A still further object of the present invention is to provide an improved stoker in which the grates thereof are protected from the deleterious effects of the flames of combustion.

Another object of the present invention is to provide an improved stoker in which the grates thereof are shielded from exposure to the flames of combustion along the entire length thereof.

A further object of the present invention is to provide an improved stoker of the reciprocating type in which refuse deposited thereon is tumbled to enhance the burning process wherein the grates thereof are shielded from the flames of combustion along the entire length of the stoker.

A still further object of the present invention is to provide an improved stoker suitable for use in municipal, industrial and commercial incinerators in which a longer service life is provided for the grates thereof.

Figure 2:
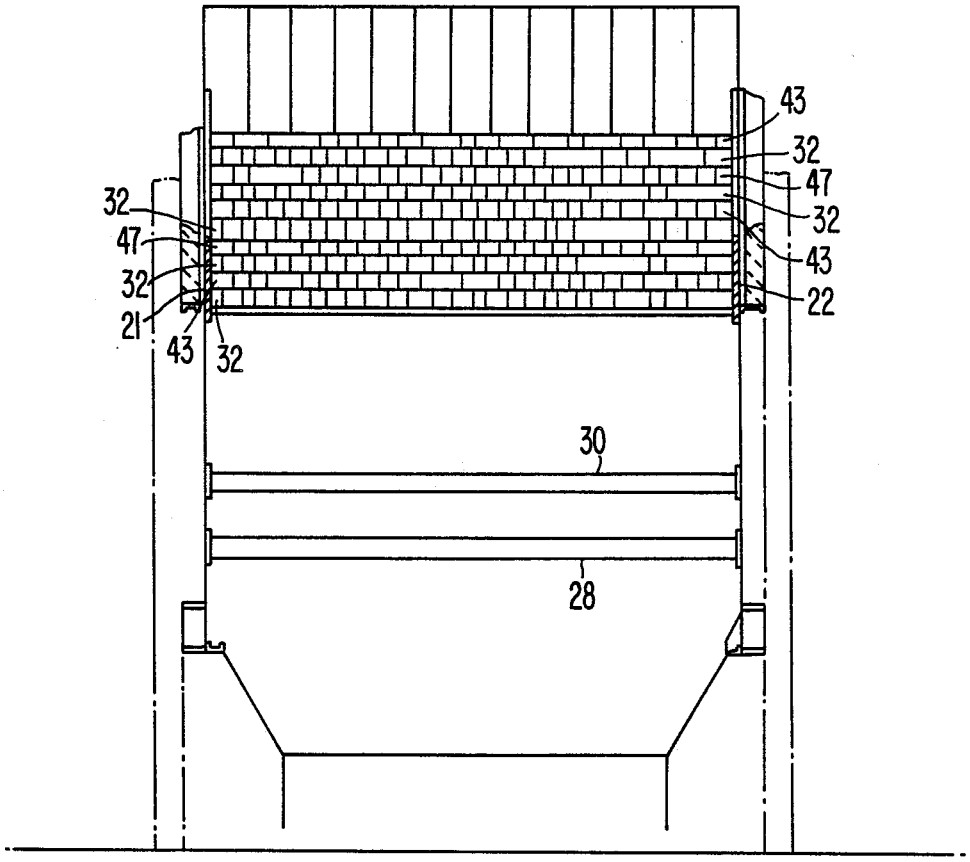

Other objects and advantages of the present invention will become more evident to those persons having ordinary skill in the art to which the present invention pertains from the following description taken in conjunction with the accompanying drawings wherein:

FIG. 1 is a vertical cross-sectional view of an embodiment of the invention; and FIG. 2 is a cross-sectional view taken along line 2—2 in FIG. 1.

Referring to the drawings, there is illustrated an embodiment of the invention generally consisting of a support frame 10 mounted on a floor member 11, a stationary assembly 12 of longitudinally spaced sets of grates, a first movable assembly 13 of longitudinally spaced grates mounted on support frame 10, a second movable assembly 14 of longitudinally spaced sets of grates mounted on the support frame, a third movable assembly 15 of longitudinally spaced sets of grates mounted on the support frame, a third movable assembly 16 of longitudinally spaced sets of grates mounted on the frame assembly, a drive system 17 supported on the support frame and operatively connected to movable assemblies 13 through 16, and a residue removal system 18 supported by the sifting hopper 10*a* disposed at the lower end of the support frame.

Generally, the support frame includes a rear wall 19, a front wall 20 and a pair of side walls 21 and 22 providing an upper, opened end. Mounted on the side walls of the support frame is a first set of the crossbeams 23 and 24 which support movable assembly 13, a set of crossbeams 25 and 26 which support movable assembly 14, a set of crossbeam members 27 and 28 which support movable assembly 15 and a set of crossbeam members 29 and 30 which support movable assembly 16. Also mounted on the upper ends of side walls 21 and 22 are a plurality of longitudinally spaced crossbeams 31. Each of crossbeams 31 supports the rear end of a transversely disposed set of stationary grates 32.

Movable assembly 13 consist of a carriage 33 having a set of shoes 34 slidably mounted on crossbeam members 23 and 24, a first plurality of longitudinally spaced sets of grates 35 and a second plurality of longitudinally spaced grates 36. The sets of grates 35 are disposed in a first set of alternate spaces between sets of stationary grates 32 and sets of grates 36 are disposed in successive spaces between sets of stationary grates 32.

Movable assembly 14 consist of a carriage 37 having a set of shoes 38 slidably mounted on crossbeam members 25 and 26 and longitudinally spaced sets of grates 39 disposed in a second set of alternate spaces between sets of stationary grates 32.

Movable assembly 15 consist of a carriage 40 having a set of shoes 41 and 42 slidably supported on crossbeam members 27 and 28 and longitudinally spaced sets of grates 43 disposed in the first set of alternate spaces between sets of grates 32 similar to the first plurality of sets of grates 35. Similarly to movable assembly 14, movable assembly 16 consist of a carriage 44 having a set of shoes 45 and 46 slidably mounted on crossbeam members 29 and 30 and longitudinally spaced sets of grates 47 disposed in the second set of alternate spaces between sets of grates 32.

Drive systems 17 are independently operable to extend sets of grates 35 and 36 of assembly 13 and sets of grates 43 of assembly 15 while retracting sets of grates 39 of assembly 14 and sets of grates 47 of assembly 16. Conversely, they are operative to extend sets of grates 39 and 47 while retracting sets of grates 35, 36 and 43. The system includes a pair of shafts 48 and 49 journalled in the side walls of the support frame or otherwise supported and means for pivoting such shafts about their transverse axes. Drive shaft 48 is provided with a set of crank arms 50 which are operatively connected to carriages 40 and 44 by means of links 51 and 52. Similarly, drive shaft 49 is provided with a set of crank arms 53 which are connected to carriages 33 and 37 by means of links 54 and 55. Typically, drive shafts 48 and 49 are pivoted through the use of hydraulic cylinders or rotary actuators operatively connected to crank arms on the drive shafts which extend and retract to impart reciprocating motions to the several carriages. It will be appreciated that when sets of grates 35, 36 and 43 are fully extended and sets of grates 39 and 47 are fully retracted as shown in FIG. 1, sets of grates 35, 39, 43 and 47 cooperate with sets of stationary grates 32 to provide a substantial drop for refuse deposited on the feed section of the stoker disposed at the trailing end thereof, and the combustion section disposed intermediate the ends thereof, and sets of grates 36 will cooperate with the sets of stationary grates to provide shorter drops for the burnt refuse deposited on the burnout section of the stoker disposed at the leading end thereof. When sets of grates 35, 36 and 43 are retracted and sets of grates 39 and 47 are extended, similar deep drops will be provided in the feed and combustion sections of the stoker and shorter drops will be provided in the burnout section. The effect of such stoking action will be to cause a greater degree of tumbling in the feed and combustion sections of the stoker where greater agitation of the newly deposited and partially burnt refuse is desired, and to cause a lesser degree of tumbling in the burnout section where it is desirable to have less agitation of the burnt residue.. The further effect of the such stoking action will be to provide optimum burning conditions while shielding the grates from the deleterious effects of the combustion flames. In the feed and combustion sections of the stoker, the grates will be shielded from the combustion flames by the newly deposited refuse in the feed section and the burning refuse in the combustion section. In the burnout section, the grates will be shielded from the combustion flames by the burned refuse. By providing less tumbling of the burnt residue in the burnout section of the stoker, the burnt refuse is less likely to be sufficiently disturbed to expose the grates in such section. The further effect of such stoking action will be to cool the ash residue prior to the discharge from the furnace, maintaining the efficiency of energy recovery from the burnt refuse.

Residue sifting through the grates and deposited at the bottom of the stoker is removed by removal system 18 which consists of a set of drive and guide rollers 56 through 59 and a paddle carrying chain 60 trained over the drive and guide rollers. The residue removal system is operable to sweep siftings on the bottom on the stoker to one end thereof from where they are discharged through a flapper door 60.

In the typical operation of the embodiment as described, refuse is charged onto the feed section of the stoker through a feed chute 61 disposed at an upper end of the stoker. As the various carriages reciprocate as described, the refused deposited on the feed section of the stoker will be caused to move and tumble down the stoker and be burned in the combustion section thereof. As the burnt refuse continues to be stoked by the reciprocating action of the grates, it will be caused to move down through the burnout section from where it is discharged from the stoker and collected for disposal. The further effect of such stoking action will be to cool the ash residue. Siftings swept by the residue removal system 18 similarly are deposited in the conveyor receiving ash from the stoker grates.

The burning of the refuse in the combustion section of the stoker is controlled in the conventional manner by regulating the volume of overfire and underfire air supplied to the combustion section of the stoker. When the temperature in the combustion chamber falls below approximately 1450° F., the volume of underfire air is increased and the volume of overfire air is decreased. If the temperature rises above approximately 1650° F., the volume of overfire air is increased and the volume of underfire air correspondingly is decreased.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. A stoker for an incinerator comprising a support means, a stationary assembly of longitudinally spaced sets of grates mounted on said support means, a first movable assembly of longitudinally spaced sets of grates mounted on said support means, said first movable assembly having first and second pluralities of sets of grates, said first plurality of grate sets being disposed in a first set of alternate spaces between sets of grates of said stationary assembly, said second plurality of grate sets being disposed in successive spaces between sets of grates of said stationary assembly, a second movable assembly of longitudinally spaced sets of grates mounted on said support means, said sets of grates of said second movable assembly being disposed in a second set of alternate spaces between sets of grates of said stationary assembly, and means for reciprocating said first and second assemblies.

2. A stoker for an incinerator according to claim 1 wherein said sets of grates are disposed in descending order in a longitudinal direction.

3. A stoker for an incinerator according to claim 1 wherein each set of grates is disposed transversely.

4. A stoker for an incinerator according to claim 1 wherein successive sets of grates of engageable in sliding relation.

5. A stoker for an incinerator according to claim 4 wherein each set of grates of said first and second movable assemblies is disposed between successive sets of grates of said stationary assembly and are in slidable engagement therewith.

6. A stoker for an incinerator according to claim 1 wherein said reciprocating means is operative in driving said first and second movable assemblies in opposite directions relative to each other.

7. A stoker for an incinerator according to claim 1 wherein the sets of grates of said first and second movable assemblies are reciprocated along lines of travel disposed at an angle relative to the horizontal.

8. A stoker for an incinerator according to claim 1 wherein said plurality of sets of grates disposed in successive spaces between sets of grates of said stationary assembly are disposed at a lower end of the other sets of grates of the first and second movable assemblies.

9. A stoker for an incinerator according to claim 1 wherein said reciprocating means is hydraulically operated.

10. A stoker for an incinerator according to claim 9 wherein said reciprocating means includes crank mechanisms operatively connected to said first and second assemblies and at least one hydraulic cylinder assembly operatively connected to said crank mechanisms.

11. A stoker for an incinerator according to claim 1 including means for removing siftings deposited below said sets of grates.

12. A stoker for an incinerator according to claim 1 wherein said support means includes guide surfaces supporting said first and second movable assemblies.

13. A stoker for an incinerator according to claim 12 wherein said guide surfaces are disposed at an angle relative to the horizontal.

14. A stoker for an incinerator according to claim 1 wherein each of said movable assemblies includes a carriage having transversely disposed beams supporting sets of grates.

15. A stoker for an incinerator according to claim 1 including third and fourth movable assemblies, said third movable assembly having longitudinally spaced sets of grates disposed in said first set of alternate spaces between sets of grates of said stationary assembly, and said fourth assembly having longitudinally spaced sets of grates disposed in said second set of alternate spaces between sets of grates of said stationary assembly.

16. A stoker for an incinerator according to claim 15 wherein said third and fourth movable assemblies are disposed in preceding order relative to said first and second movable assemblies.

17. A stoker for an incinerator according to claim 16 wherein the sets of grates of said third and fourth assemblies are disposed in descending order in a longitudinal direction.

18. A stoker for an incinerator according to claim 16 wherein each set of grates is disposed transversely.

19. A stoker for an incinerator according to claim 16 wherein said sets of grates are disposed in descending order in a longitudinal direction.

20. A stoker for an incinerator according to claim 1 including means for supplying combustion air below said grates.

21. A stoker for an incinerator according to claim 1 including means for supplying combustion air above said grates.

22. A stoker for an incinerator according to claim 1 wherein said support means includes means defining a plenum chamber disposed below said sets of grates.

23. A stoker for an incinerator according to claim 22 wherein said support means includes means disposed below said sets of grates for removing siftings.

24. A stoker for an incinerator according to claim 23 wherein said removing means comprises an endless conveyor having paddles mounted thereon for sweeping siftings along the length thereof.

* * * * *